United States Patent [19]

Weston

[11] 3,964,997

[45] June 22, 1976

[54] CONCENTRATION OF GOLD, SULPHIDE MINERALS AND URANIUM OXIDE MINERALS BY FLOTATION FROM ORES AND METALLURGICAL PLANT PRODUCTS

[76] Inventor: David Weston, 34 Parkwood Ave., Toronto, Ontario, Canada

[22] Filed: Sept. 26, 1974

[21] Appl. No.: 509,428

Related U.S. Application Data

[63] Continuation-in-part of Ser. No. 409,328, Oct. 24, 1973, abandoned, which is a continuation-in-part of Ser. No. 339,384, March 3, 1973, Pat. No. 3,919,079.

[52] U.S. Cl. ..... 209/166; B03D/00/03

[51] Int. Cl.[2] ..... B03D 1/02

[58] Field of Search ..... 209/166, 167

[56] References Cited

UNITED STATES PATENTS

| | | | |
|---|---|---|---|
| 1,236,501 | 8/1917 | Tippett | 209/166 X |
| 1,240,597 | 9/1917 | Perkins | 209/166 |
| 1,377,189 | 5/1921 | Dosenback | 209/167 |
| 1,518,829 | 12/1924 | Thornhill | 209/166 X |
| 1,554,216 | 9/1925 | Keller | 209/166 |
| 1,619,790 | 3/1927 | Bragg | 209/166 |
| 1,668,917 | 5/1928 | Lewis | 209/166 |
| 2,693,877 | 11/1954 | Drake | 209/164 |
| 3,307,790 | 3/1967 | Cohn | 209/166 X |
| 3,450,257 | 6/1969 | Lundy | 209/5 |
| 3,589,622 | 6/1971 | Weston | 209/166 X |
| 3,735,931 | 5/1973 | Weston | 209/166 X |

OTHER PUBLICATIONS

Tech Paper No. 410, Aimme, Feb. '31, p. 30.

Chem. Abst. 70, 1909, 70365s.

Chem. Abst. 73, 1970, 100521w.

Gaudin, Flot, 1957, pp. 453, 454.

Theory of Flot, Klassem & Mieknusov 1963, pp. 393, 394.

Taggart, Handbook of Min. Dressing, 1947, 12–26, 12–27.

Taggart, Handbook of Min. Dressing, 1947, 2–70, 2–75, 2–102, 109, 2–117, 2–114, 2–128.

*Primary Examiner*—Robert Halper

*Attorney, Agent, or Firm*—Depaoli & O'Brien

[57] ABSTRACT

A process for the concentration by flotation of gold, gold bearing minerals and uranium oxide minerals from ores and metallurgical plant products whereby a pulp of a ground ore is agitation conditioned in at least two agitation conditioning stages wherein in at least one stage the pH of the pulp is lowered with an acid agent to within the pH range of about 1.5 to 5.0, and wherein in at least one additional agitation conditioning stage the pH of the pulp is raised to within the pH range of about 6.0 to 11.0 and wherein in at least the last stage prior to flotation at least one collector selected from the group of sulfhydryl anionic collectors is present, and subsequently, the at least two stage agitation conditoned pulp is subjected to flotation to produce a flotation concentrate enriched in at least one of the mineral values from the group consisting of gold, gold bearing minerals and uranium minerals.

41 Claims, 4 Drawing Figures

PREFERRED FLOWSHEET OF THE INVENTION WITH PRE-FLOAT FOR THUCHOLITE RECOVERY

PREFERRED FLOWSHEET OF THE INVENTION WITH THUCHOLITE RECOVERY FLOTATION STEP FOLLOWING "K" AT FIGURE 1A

CONCENTRATION OF GOLD, SULPHIDE MINERALS AND URANIUM OXIDE MINERALS BY FLOTATION FROM ORES AND METALLURGICAL PLANT PRODUCTS

RELATED APPLICATION application is a continuation in part of application Ser. No. 409,328, filed October 24, 1973 now abandoned, which application is a continuation in part of Ser. No. 339,384 filed March 3, 1973 now Pat. No. 3,919,079.

BACKGROUND OF THE INVENTION

This invention is primarily applicable to the recovery by flotation of gold from ores and metallurgical plant products such as the treatment of a gold ore in a metallurgical circuit following gravity concentration. It is further applicable to the recovery of gold values remaining in the tailings after treatment by cyanidation. Further, where valuable sulphides are present in such ores such as pyrite, which may be further processed for the production of sulphuric acid and in addition, the pyrite may carry substantial gold bearing sulphide, or complex mixtures of sulphides such as arseno pyrite, which may be a gold bearing mineral, silver sulphides or complex sulphide minerals of bismuth, all such minerals together with the gold values may be floated as a single bulk concentrate with surprisingly high recovery of all of such minerals present. In certain materials, which in addition to gold contain uranium values a surprisingly high percentage of the uranium minerals are also recovered in the same bulk flotation concentrate.

In treating simple metallurgical gold bearing ores the cyanide process has been the conventional practice for many years. Recovery of the gold values in using such a process may vary from a low of about 90% to a high of about 98% of the contained gold. Such ores and treatment are typical of the deposits in the Republic of South Africa wich produces by far the bulk of the world output of gold. Heretofore the major part of gold values in the tailings from these plants was thought to be contained in totally locked particles where the cyanide was unable to attack the gold particles and thus were unavailable for leaching by the cyanide process.

In carrying out research on these ores with my flotation process I found that this theory was wrong as in a high grade flotation concentrate I was able to recover in excess of 75% of the total gold values remaining in such plant tailings following cyanidation. Further, in using a sulfhydryl anionic collector as the only collector, up to 50% of the uranium values occurring in tailing floated in the same concentrate with the gold. A further surprising feature was the very high recovery of the pyrite. Cyanide is known as one of the most effective depressants for pyrite and in applying my process to old plant tailings, which in addition to having been treated by the cyanide process were also oxidized through years of storage in a tailings disposal area, the pyrite recovery which in this case has a major economic value for sulphuric acid production, readily floated in the same circuit and recoveries were in excess of 90% of the contained pyrite in the tailings.

In applying my invention to ores, or metallurgical plant products, I use at least one sulfhydryl anionic collector. On ores or metallurgical plant products containing metallic oxides, to improve their recovery, I prefer to use at least one sulfhydryl anionic collector in combination with at least one other collector selected from the group consisting of oxyhydryl collectors and cationic collectors. The sulfhydryl anionic collectors, oxyhydryl anionic collectors and cationic collectors are well known in the art and classified in "Flotation" Second Edition, A.M. Gaudin, McGraw Book Company, Inc., New York, 1957, pages 184–186.

The term "Agitation Conditioning Stage" normally consists of a multiplicity of agitators. In my preferred circuit I prefer to use a minimum of two agitation conditioners in any single conditioning stage. The usual distinguishing feature between each agitation conditioning stage is where I either add an acid agent or an alkaline agent to change the pH range within the individual agitation conditioning stage. Alternately, where I add an acid agent to lower the pH of the pulp within the pH range of about 1.5 to about 5.0 the initial pH may be at 1.5 and due to the acid consuming constituents in the material being treated may rise to as high as a pH of 7 at the end of this acid conditioning stage. Where my next stage is in the pH range of about 6.0 to 11.0 I may not add an alkaline agent to change the pH, but at the end pH of the acid stage add a collector such as potassium amyl xanthate and condition for a sufficiently long period and with sufficient power input to the pulp to heavily activate the desired recoverable minerals. In this case, at the beginning of the second stage the pH will be 7.0 and the pH may be slightly higher or lower at the end of the second stage say within the pH range of 6.5 to 7.5 prior to the pulp being fed to the flotation circuit with the final addition of a suitable frother.

By "Acid Agent" I mean at least one agent selected from the group consisting of sulphuric acid, sulphurous acid and sulphur dioxide, and is used to lower the pH in the alkaline pH range or reduce the pH of the pulp to a desired point or range in the acid pH range of about 1.5 to about 5.0. My preferred acid agent is sulphuric acid.

By "Alkaline Agent" I mean an agent selected from the group consisting of lime, calcium hydroxide, sodium carbonate, potassium carbonate, sodium hydroxide and ammonium hydroxide, and is used for upward adjustment of the pH of the pulp.

When I use the term "pounds per ton" of various reagents, this is pounds per metric ton of the total original feed to my circuit, unless otherwise specified.

In describing the practice of my invention the term "agitation conditioning" as distinguished from conventional practice is important.

In mixing reagents with the pulp to procure collector coating of sulphide minerals conventional practice uses the lowest possible agitation conditioning speeds with the main purpose being to keep the solids in the pulp in suspension and distribute the reagents throughout the pulp. To quote Taggart, "Handbook of Mineral Dressing", John Wiley & Sons Inc., New York, March 1947, Section 12, page 20: "With fine pulps large tanks and slow agitation as by slow sweeps, will serve, the principal consideration in this case being dispersion of the reagents."

Conversely, in my agitation conditioning stages I use vigorous to violent agitation with substantially higher power to the agitator mechanism or mechanisms than would be required to keep a finely ground product of the ore in suspension at a specific pulp density. The power input to comparable sized agitators in the practice of my invention is normally at least twice the amount of power that would be required alone to keep the solids in the pulp in suspension.

The agitation conditioning times are important. In my at least one acid conditioning stage in the pH range of about 1.5 to 5.0 to obtain optimum results, the minimum agitation conditioning time is about 6 minutes and the maximum about 30 minutes. The optimum range is normally in the time period of about 9 minutes to about 18 minutes. In my at least one additional agitation conditioning stage in the pH range of about 6.0 to 11.0 the minimum period of time is about 3 minutes and the maximum about 20 minutes.

Where I refer to an "optimum pH point", I mean the practical pH point at which the pulp can be maintained. For instance, if I refer to an optimum pH point of 7.5 in an alkaline agitation conditioning stage, in plant practice it may vary plus or minus approximately 0.2 with erratics due to changes in plant operating conditions or poor operating plant control.

When I refer to "optimum pH point" for instance in an acid conditioning stage it may be a range of pH's particularly if the ore consumes a high percentage of the acid agent fed to it. For instance on the addition of sulphuric acid to the first agitator in a three step (three agitators) agitation conditioning stage, the pH of the pulp may drop to as low as 1.5, and then at the end of say the third agitator which would represent a total conditioning time of 15 minutes, the pH of the pulp will have risen to say about 5.0. In this case, the optimum pH point would be at a designated recording point in the first agitator, or at its discharge point.

In describing my invention the expression "suitably prepared pulp" of an ore or material, when used herein is intended to mean that the pulp has been made up from a material that has been ground to flotation feed size for reasonable liberation of the desired mineral constituents and has during such comminution or thereafter been subjected to such treatment steps (such as adjustment of pulp density by dilution, thickening, thickening and dilution) as the operator may deem appropriate in the case of the particular material being treated, to present the pulp for the agitation conditioning stages of treatment comprising the process of the present invention.

The principal object of the invention is to provide a process for the economic recovery of gold values by flotation from various types of ores and metallurgical plant products such as the tailings from a cyanidation plant.

It is a further object of the invention to float in the same circuit sulphide minerals, and if present, oxide minerals of uranium.

It is a further object of the invention to produce high grade gold concentrates from gold bearing ores and metallurgical plant products.

It will be appreciated that with the production of high grade gold concentrates such as in the case of from cyanidation plant tailings in the Republic of South Africa, the ratio of concentration will be as high as 80 to 1. Thus, with such a concentrate, which would represent 1.25% of the original tailings and containing in excess of 75% of the gold values and up to 50% of the uranium values together with in excess of 90% of the pyrite values, such a concentrate can be further treated in a number of conventional ways. For instance, the concentrate may be first rotated recovering the sulphur from the pyrite to produce sulphuric acid. Following this step the roasted product can be acid leached with sulphuric acid to recover the uranium values. Following this step the tailings from the acid leaching process can be cyanided to recover the gold values.

It is a further object of the invention to recover minerals other than gold such as the platinum group minerals from both ores and metallurgical plant products.

FIG. 1 shows a preferred arrangement of a two stage agitationing conditioning system.

FIG. 1A shows a preferred flowsheet of the invention using cyanide plant residues as the feed.

FIG. 2 shows a flowsheet with a pre-float for Thucholite recovery and

FIG. 3 shows a flowsheet with the Thucholite recovery Flotation Step following "K" at FIG. 1A.

SUMMARY OF THE INVENTION

I have invented a flotation process for the recovery of gold values and other valuable minerals contained in ores and metallurgical plant products.

In the broad concept of the process the invention involves mechanical agitation conditioning of a suitably prepared pulp of the material in at least two agitation conditioning stages wherein in at least one stage the pH of the pulp is lowered with an acid agent to within the pH range of about 1.5 to about 5.0 and agitation conditioned for a sufficient period of time to bring about sufficient change in the surfaces of gold and gold bearing minerals and other valuable minerals such as pyrite, uranium minerals and platinum group minerals and wherein in at least one subsequent additional mechanical agitation conditioning stage in the pH range of about 6.0 to 11.0 in the presence of at least one collector selected from the group of sulfhydryl anionic collectors, the pulp is further conditioned for a sufficient period of time to bring about heavy activation of the desired valuable contained minerals, and subsequently, to this at least two agitation conditioning stages the pulp, in the presence of a frother, is subjected to flotation to produce a flotation concentrate enriched in those mineral values and a tailings impoverished in thos mineral values.

Where other valuable minerals are present in a gold bearing material such as pyrite which may for instance contain gold particles in its lattice structure or alternately be free of gold but is of economic value in the production of sulphuric acid, and such sulphide minerals as arsenopyrite, complex bismuth sulphide minerals and silver sulphide minerals, high recoveries of all of these minerals may be made in a single flotation concentrate containing the gold values. It is obvious that where any of such sulphide minerals are present in economic quantities without the presence of gold values, my process could be of significant importance.

Where oxide minerals of uranium are present, surprisingly, on some materials a relatively high percentage of these minerals will float with the gold and sulphides using a sulfhydryl anionic collector alone. To enhance their recovery I may also use a combination of sulfhydryl anionic collectors together with at least one collector selected from the group of oxhydryl anionic collectors and cationic collectors. In such a case I may also use fuel oil.

In the at least one agitation conditioning stage in the pH range of about 1.5 to 5.0 I prefer to use pulp densities in the range of about 35 to 65% solids. My preferred range is 40 to 60% solids. In the at least one agitation conditioning stage in the pH range of about 6.0 to 11.0 my preferred density is in the range of about 25 to 32% solids.

The energy input to the pulp is of importance. My preferred range of total power consumption of the agitation mechanisms is in the range of about 0.50 to about 2.5 kilowatt hours per ton of solids fed to the total agitation conditioning circuit.

For optimum metallurgy on various materials my first stage of agitation conditioning may be in the pH range of about 6.0 to about 10.0 in the presence of either a dispersing agent or collector selected from the group of oxhydryl and cationic collectors, or both, and followed by agitation conditioning stages in the pH range of about 1.5 to 5.0 and about 6.0 to about 11.0; this arrangement would form a three stage agitation conditioning circuit. Such a system would be applicable to materials containing valuable metallic oxides. On other materials containing a varied range of valuable sulphide minerals I may use an additional agitation conditioning stage subsequent to the said two necessary stages wherein prior to flotation the pulp is conditioned in the pH range of about 7.0 to about 11.0. This arrangement would form either a three stage or four stage agitation conditioning circuit.

The use of dispersants in my invention may be of importance in special cases such as materials that contain deliterious slimes. In my minimum two stage system I prefer to add at least the bulk of my dispersant to the second stage in the presence of one or more of the collectors. In using a three stage system as described above I may use the dispersant in the first stage alone. In the four stage system described above I may use the dispersnat in the first and third or fourth stages or a combination of the first with the third stage or the first with the fourth step.

It will be appreciated that the pulp flow is through a series of mechanically agitated conditioners arranged in series wherein the pulp flows from one agitator to the next from the first agitation conditioning stage through to the final agitation conditioning stage. The normal system uses gravity flow between agitators. In some arrangements one or more pumping, or air-lifting stages may be used.

Figure 1:
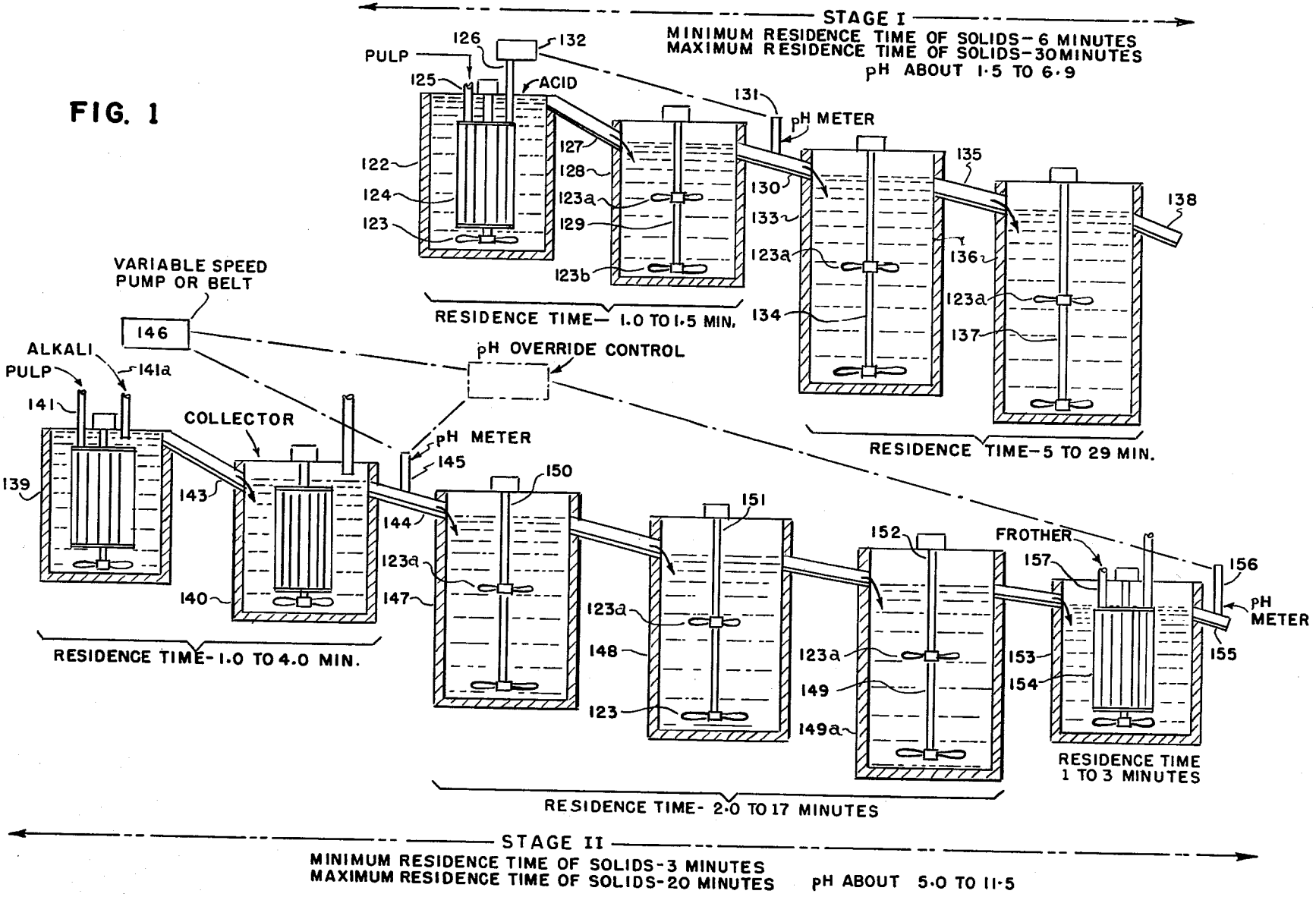
FIG. 1

In using my minimum two stage agitation conditioning system FIG. I shows my preferred arrangement beginning with an agitation conditioning stage in the pH range of about 1.5 to 5.0 and wherein an acid agent is added to the pulp. In the first agitator 122 in the series the pulp enters the agitator at 125 and sulphuric acid is added to the same agitator at 126. The agitation mechanism is 123. The pulp discharges by gravity at 127 to the number 2 agitator 128. This agitator is equipped with two agitation mechanisms, 123*a* and 123*b*. The pulp from agitator 128 flows by gravity through the conduit 130 to agitator 133 where automatic pH control of the sulphuric acid is used. A pH meter 131 in the conduit 130 records the pH at this point and automatically controls the amount of sulphuric acid fed to the pulp at 126. Tanks 133 and 136 are designed to give the additional requisite residence time required in this agitation conditioning stage. The pulp from tank 136 flows by gravity through the conduit 138 to agitator 139 at 141. The pulp pH may have risen to within the pH range of 6.0 to 11.0 and it may not be necessary to add an alkali agent as shown at 141*a* for this final agitation conditioning stage. If an alkali agent is required it is added to the agitator 139 which overflows at 143 into tank 140 where preferably the collector is added, and if a dispersant is used it may be added at this point or in any subsequent agitator in this agitation conditioning stage. As is shown, the pulp flows by gravity from agitator 140 to agitator 147 then by gravity to agitator 148; from 148 to 149*a* and from 149*a* to 153 and from 153 through conduit 155 to flotation. Where an alkali agent is added at 141*a* for automatic control a pH meter at 145 in conduit 144 may be used to automatically control the amount of alkali or alternately or in combination with a pH meter 156 in the conduit 155 where the pH of the final pulp to flotation would override the pH meter 145 if so required. My preferred addition of the frother is in the final agitator 153 at 157.

Figure 1A:
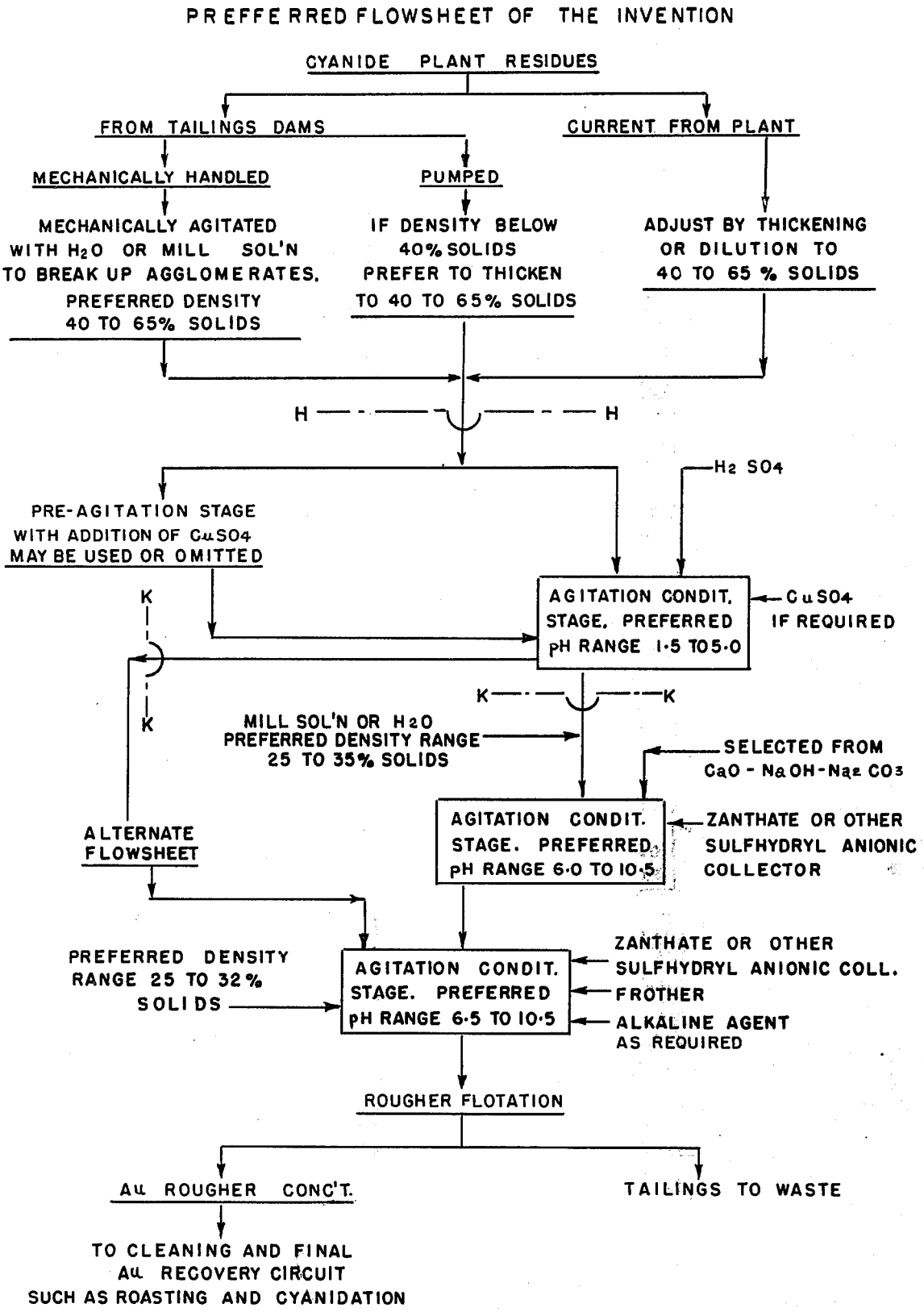

My preferred flowsheet of a two and three stage agitation conditioning circuit is shown at FIG. 1A.

In some gold bearing materials such as occurs in South African gold mine deposits there is a carbon based material containing varying amounts of ultra-fine gold particles and uranium oxides. This carbon based mineral is called Thucholite. In the cyanide process for the dissolution of the gold it has been found that the ultra-fine gold particles contained in the Thucholite appears to be relatively untouched by the action of the cyanide. Thus, the Thucholite passing into the tailings carries various amounts of gold values.

As with other types of carbon minerals, Thucholite may be floated using a frother alone or a frother in combination with a modifier such as fuel oil.

Figure 2:
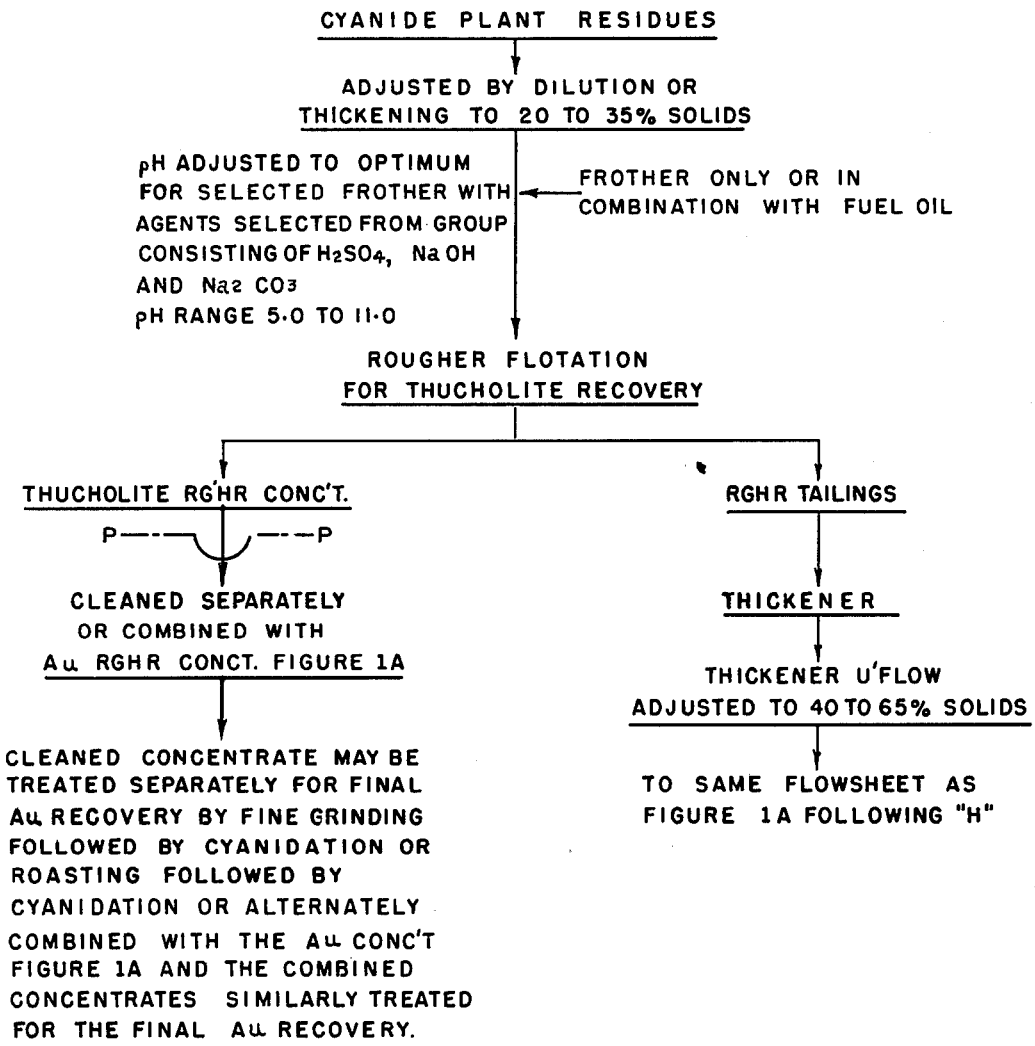
Figure 3:
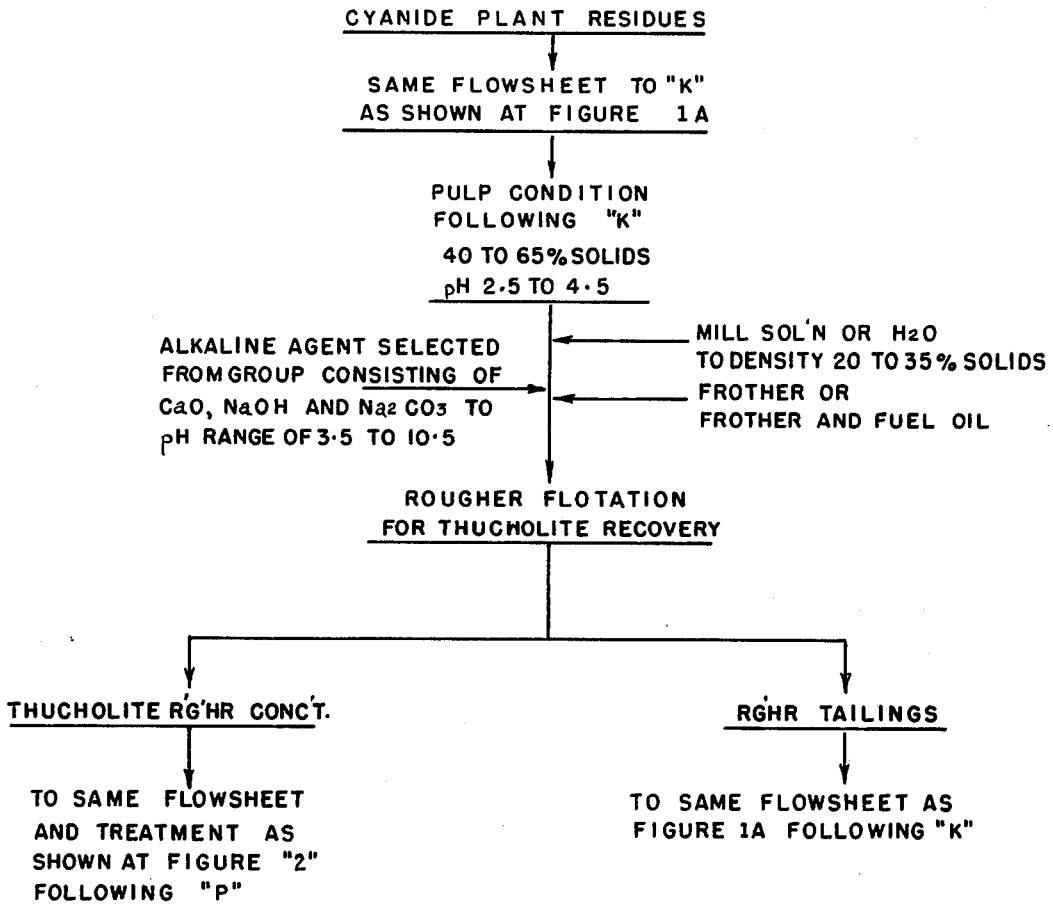

Under such conditions it may be advantageous to float the Thucholite in a separate concentrate from my main flotation stage, as is shown in FIG. 1A, and either combine the two concentrates subsequent to rougher flotation or alternately treat the concentrates separate for the gold recovery, such as burning the carbon in the Thucholite concentrate to release the gold particles where they can then be amenable to flotation or alternately combining the Thucholite concentrate with the essentially gold and pyrite concentrate, roasting the two together, and treating the roasted product to cyanidation for the dissolution of the gold prior to its final recovery stages. Two alternate flowsheets for such a recovery system are shown at FIGS. 2 and 3 which are self explanatory. FIG. 1A shows the preferred flowsheet of the invention and is self explanatory.

In optimizing the Thucholite recovery in plant practice a flotation stage following the production of my rougher concentrate using addition of frother may produce the maximum economic recovery of the mineral values. The Thucholite is herein also referred to as carbon and a gold bearing mineral.

EXAMPLES OF THE INVENTION

A more detailed understanding of the invention may be had by reference to the following examples of laboratory testing which in the first examples are on an extremely complex gold bearing ore containing sulphide minerals of silver, bismuth, copper and arsenic together with a substantial amount of pyrite. The second group of examples are on tailings from a highly efficient cyanide plant treating a gold ore in the Republic of South Africa. In this latter case, in addition to the gold values the ore contained a small percentage of pyrite which is economically important in the production of sulphuric acid, together with uranium values and platinum group metal values.

In the following examples 1 to 5, the head analysis of the ore treated was as follows:

| Chemical Analysis | | | | | |
|---|---|---|---|---|---|
| % By Weight | | | | Grams per Ton | |
| As | Cu | Bi | S | Au | Ag |
| 11.0 | 0.16 | 0.185 | 15.5 | 8.4 | 70.0 |

The calculated percentage by weight of the main minerals was as follows:

| | |
|---|---|
| Arsenopyrite | 23.9% |
| Chalcopyrite | 0.5% |
| Bismuth Minerals (not identified-estimated) | 0.4% |
| Pyrite | 20.0% |
| Total % Sulphides | 44.8% |

The strengths of the solutions used were as follows:
Sulphuric Acid — 10% by weight
Potassium Amyl Zanthate - $Z_6$ —1.0% by weight 90
Sodium Silicate — 10% by weight The ore charge weight used in each test was 1700 grams. This ore had been crushed to minus ½ inch and for all tests was ground in a laboratory ball mill at 70% solids to approximately 90 percent minus 200 mesh, and transferred to a 1000 gram Denver Laboratory Cell Bowl. All the conditioning stages and flotation were carried out in the 1000 gram bowl using a Denver Laboratory Machine operated at speeds in the range of 1900 to 2100 r.p.m.

The density in the first conditioning stage was in the range of 45 to 55% solids and the subsequent stages, and to flotation, at 32 to 34% solids. The flotation time in all cases was 20 minutes with two small additions of the collector.

EXAMPLE 1

The first agitation conditioning stage consisted of lowering the pH of the pulp from 8.6 to 3.1 by the addition of 70 ccs of $H_2SO_4$. The pulp was conditioned for 12 minutes and the end pH was 6.3.

The pH of the pulp was then raised to 6.5 with the addition of lime and 15 ccs of $Z_6$ added to the pulp. conditioned This second agitation conditioning stage was 5 minutes and the end pH was 7.3 . The pH of the pulp was then raised to 9.5 with the addition of lime. 10 ccs of $Z_6$ was added together with 15 drops of pine oil and the pulp conditoned in this third agitation conditioning state for 5 minutes. The end pH was 9.5.

The air was then turned on, and the float carried out for 20 minutes with two 5 cc additions of $Z_6$.

EXAMPLE II

The same agitation conditioning stages were used as in Example I together with the same amounts of $Z_6$.

The major difference was in the $H_2SO_4$ addition; it was increased to 100 ccs. No alkali agent was added in stage II, and in stage III the pH was raised to 9.0 with lime.

The original pH of the pulp was 8.4 and after the $H_2SO_4$ addition dropped to 2.3 and at the end of stage I was 4.6.

The pH at the end of stage III was 7.9 and the amount of pine oil added to stage III was increased to 20 drops.

The percent weight in the rougher concentrate dropped from 59.3% in Example I to 52.7% and contained 94.6% of the total gold in the ore, as against 94.2% in Example I.

This was a surprising drop in weight with an increase in gold recovery.

EXAMPLE III

This test was identical to Example I with the exception of sodium carbonate being added as the alkali agent to stages II and III and the pHs in stages II and III brought up to 7.0. The end pH of stage III was 6.8.

The rougher concentrate was 54.9% by weight and contained 94.6% of the total gold values in the ore.

EXAMPLE IV

This test was close to optimization for the recovery of all of the desired minerals in the ore.

In storage I the pH was lowered from 8.8 to 2.4 by the addition of 100 ccs of $H_2SO_4$. At the end of the stage (12 minutes conditioning) the pH had risen to 6.5. For stages II and III no alkali agent was added to the pulp. Stage II was 4 minutes conditioning with 12 ccs $Z_6$ and the end pH was 6.1.

Stage III was 6 minutes conditioning with 8 ccs $Z_6$ and 15 drops of pine oil. The end pH was 5.4. The rougher concentrate was 54.6% by weight and contained the following percentage of the valuable mineral constituents of the ore:

| Percentage Recovery in Rghr. Conct. | | | | | |
|---|---|---|---|---|---|
| Au | Ag | Cu | Bi | As | S |
| 95.3 | 94.6 | 97.1 | 97.5 | 97.5 | 99.4 |

In addition to the recovery of 95% of the gold, the recovery of in excess of 99% of the total sulphides contained in the ore is an amazing result.

EXAMPLE V

This test was the same as Example IV with the exceptions of the $H_2SO_4$, which was reduced to 90 ccs, and the addition of 4 ccs sodium silicate to stage III. In addition stage II and stage III were each of 5 minutes duration.

The pH at the end of stage I was 5.8, and at the end of stage III 5.5.

The rougher concentrate was 54.8% by weight and contained the following percentage recoveries of the valuable mineral constituents:

| Percentage Recovery in Rghr. Conct. | | | | | |
|---|---|---|---|---|---|
| Au | Ag | Cu | Bi | As | S |
| 98.0 | 94.4 | 97.9 | 96.5 | 96.7 | 99.7 |

The effect of the presence of a small amount of dispersant in stage III is surprising in its effect on the gold recovery which was increased from 95.3% in Example IV to 98%.

The following series of Examples VI to IX were carried out on the tailings from a cyanidation plant in the Republic of South Africa. These ores respond extremely well to the cyanide process with recoveries exceeding 90% of the contained gold values. Prior to my invention the major gold losses in the cyanide tailings was thought to be in totally locked particles in which it was impossible for the cyanide solution to come into contact with these particles and dissolve them. As the grinding was already fine, it was considered uneconomic to grind the ores further.

It was most surprising to find that with my invention in excess of 75% of the gold values contained in these cyanide plant tailings could be recovered by flotation.

A further surprising result was that in tailings which had been stored in a tailings pond for several years in which at least part of the pyrite would have been oxidized, in excess of 90% of the pyrite floated with the gold values.

A further surprising result was that in using a sulfhydryl collector alone, in excess of 50% of the uranium values contained in the tailings floated with the gold and pyrite.

In the following series of tests cleaner concentrates were produced analyzing 60 grams of gold and 5 kilograms of $U_3O_8$ per metric ton of concentrate. For comparative purposes and means of illustrating the invention the gold recoveries in the rougher concentrates are shown.

In all of the following tests in the production of the rougher concentrates the tailings samples were treated in my process without any grinding. Denver Laboratory Cells were used for both the agitation conditioning stages and flotation. The speed of the rotors was varied from 1800 r.p.m. to 2100 r.p.m. 1500 gram charges were used. Unless otherwise noted, the density in stage I was 50% solids, and in Stages II and III 30 to 32% solids.

The reagent strengths were the same as for the first five examples.

Copper sulphate solution was 5%.

The percent gold recovery was calculated from the head analysis and the analysis of the rougher concentrates, as this was considered the most accurate method of calculating gold distribution due to the low gold content of the tailings.

The head sample of Examples VI and VII was 1.10 grams gold per metric ton, and Examples VIII and IX on a second sample, 1.12 grams gold per metric ton.

The fineness of the tailings sample as treated was approximately 80% minus 200 mesh.

EXAMPLE VI

Four agitation conditioning stages were used in this test. The original pH of the pulp was 7.8.

Stage I was 6 minutes with the addition of 2 ccs copper sulphate. The pH dropped to 7.45 and at the end of the stage was 7.55. Pulp density for stages I and II was 50% solids.

Stage II was 15 minutes conditioning time with the addition of 40 ccs $H_2SO_4$. The pH dropped to 2.7 and ended the stage at 4.5. At the beginning of Stage III the pulp was diluted to about 32% solids and $Na_2CO_3$ was added as the alkali agent to raise the pH of the pulp to 6.5. 12 ccs of $Z_6$ was added to the pulp and the conditioning time was 4 minutes. In Stage IV the pH of the pulp was raised to 8.0 with $Na_2CO_3$, 3 ccs of $Z_6$, 2 ccs of $Na_2SiO_3$, and 8 drops of pine oil were added to the pulp. Time of conditioning was 6 minutes, followed by a rougher float of 10 minutes duration.

The rougher concentrate was 8.77% by weight and contained 77.1% of the gold values in the original tailings feed sample.

I have found that the addition of copper sulphate to one or more points in my agitation conditioning circuit has a number of effects, the most surprising of which is a beneficial affect on the uranium mineral recovery under some conditions of reagent balance. The explanation of this phenomenon or its optimum use has not been determined.

The recovery of 77% of the gold values in a rougher concentrate of 8.77% by weight from the cyanide treatment plant tailings is not only considered outstanding, but prior to my invention, an impossible accomplishment.

EXAMPLE VII

The following table sets out the operating conditions on the same sample of cyanide plant tailings used in Example VI. The pulp was diluted to approximately 32% solids following stage I;

| Stage No. | Agit. Condit. Time-Mins | pHs | Reagent Additions $H_2SO_4$ ccs | CaO To pH | $Z_6$ ccs | $Na_2SiO_3$ ccs | Pine Oil Drops |
|---|---|---|---|---|---|---|---|
| | Pulp | 8.2 | | | | | |
| | Begin | 3.1 | | | | | |
| I | 15 End | 5.4 | 30 | | | | |
| | Begin | 7.0 | | | | | |
| | End | 6.2 | | | | | |
| II | 4 | | | To 6.0 | 9 | 12 | |
| | Begin | 7.0 | | | | | |
| | End | 7.0 | | | | | |
| III | 8 | | | To 7.0 | 6 | | 7 |

Float time — 10 minutes.

It will be noted in this test that the dispersing agent, sodium silicate, was added to stage II.

The rougher concentrate was 11.0% by weight and contained 84.2% of the gold values. A number of sulfhydryl anionic collectors were tested during this research program including sodium isopropyl xanthate, sodium secondary butyl xanthate, and potassium ethyl xanthate. On each material it is necessary to test a broad spectrum of sulfhydryl anionic collectors, such as the dithiophosphates both singly and in combination with other members of this family of collectors to arrive at the optimum economic recovery of the contained values in the material being treated.

EXAMPLE VIII

The following table sets out the operating conditions of this test.

| Stage No. | Agit. Cond. Time-Mins | pHs | $H_2SO_4$ ccs | CaO To pH | $Z_6$ ccs | $Na_2SiO_3$ ccs | Pine Oil Drops |
|---|---|---|---|---|---|---|---|
| | Pulp | 8.0 | | | | | |
| | Begin | 2.3 | | | | | |
| | End | 4.65 | | | | | |
| I | 18 | | 40 | | | | |
| | Begin | 5.5 | | | | | |
| | End | 5.6 | | | | | |
| II | 4 | | | 5.5 | 11 | | |
| | Begin | 9.5 | | | | | |
| | End | 9.4 | | | | | |
| III | 8 | | | 9.5 | 4 | 0.0 | 8 |

Float 12 minutes
Rotor r.p.m. — 2100

The rougher concentrate from this test was 9.54% by weight and contained 78.4% of the gold values.

The rotor speed of the agitation conditioning mechanism was at the high end of the energy input curve for this machine.

No dispersant was used.

EXAMPLE IX

This example was a duplicate of Example VIII with the exception of the r.p.m. of the machine rotor which was reduced to 1900 r.p.m., the lower end of the optimum energy input curve, and 8 ccs of a dispersant, sodium silicate, was added to stage III.

The rougher concentrate weight was 9.95% and contained 87.7% of the gold values. This was a surprising result. Normally, with the use of a dispersant the rougher concentrate weight is lowered due to the rejection of a higher percentage of the host rock slimes. The logical explanation in this case is that with the use of the dispersant, and the increased weight of the rougher concentrate together with a large increase in gold value recovery is that additional gold bearing particles are being activated, and particularly low middling particles that are making up the increased weight floated.

I have found that all of the commonly used families of dispersants such as the lignen sulphonates, and pyrophosphates usually act equally as well in my agitation conditioning circuit. In the final analysis it is a matter of economics in determining which specific dispersant is used.

On some materials I have found the energy input to the pulp through the agitation mechanisms to be critical while in other cases there is a broad range. In translating the power drawn by the motors driving the agitation conditioning mechanisms into kilowatt hours per metric ton of solids treated my preferred range is 0.5 to 2.5 kw hours per ton of solids treated. The minimum is about 0.25 kw hours and the maximum about 5.0 kw hours respectively per dry metric ton of solids treated. In the treatment of gold bearing materials my preferred pH range in the at least one agitation conditioning stage wherein the pH of the pulp is lowered with an acid agent is 1.5 to about 5.0 and in the at least one subsequent agitation conditioning stage in the presence of at least one collector selected from the group consisting of sulfhydryl anionic collectors my preferred pH range is 6.0 to 11.0.

It will be appreciated from the illustrations that on each material there will be an optimum pH point in each of the at least two agitation conditioning stages wherein maximum recovery of the contained mineral values will be obtained. By through testing at 0.5 pH changes in each of the at least two agitation conditioning stages, one skilled in the art will be able to arrive at the optimum pH points for the maximum mineral value recovery for any individual material.

The acid agent may be added to the pulp on a "pounds per dry ton of solids" basis or alternately to a desired "optimum pH point" by automatic pH control. The alkaline agent is added by either manual of automatic pH control to the "desired optimum pH point".

What I claim is:

1. A process for the recovery by froth flotation of mineral values selected from the group consisting of gold, silver sulphide minerals, bismuth sulphide minerals and uranium oxides associated with gold value, from complex ores and metallurgical plant products containing at least one of said minerals comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of at least one of the said mineral values in at least one subsequent mechanical agitation conditioning stage wherein the said pulp is further agitation conditioned for a sufficient period of time and at an optimum pH point in the pH range of about 5.0 to 11.5 and in the presence of an alkaline agent when the said optimum pH point is in the pH range of about 6.0 to 11.5 and in the presence of at least one collector selected from the group of sulfhydryl anionic sulphide mineral collectors to produce the said heavy activation of at least one of the said mineral values; and subsequently in the presence of a frother subjecting the said agitation conditioned pulp to flotation to produce a concentrate enriched in at least one of the said mineral values, and a tailings product impoverished in at least the same said mineral value.

2. The process of claim 1, wherein subsequent to the said at least one agitation conditioning stage in the pH range of about 1.5 to 5.0 there are at least two agitation conditioning stages in the pH range of about 5.0 to 11.5.

3. The process of claim 1, wherein preceeding the said at least one agitation conditioning stage in the pH range of about 1.5 to 5.0 there is at least one agitation conditioning stage in the pH range of about 6.0 to 10.5.

4. The process of claim 1, wherein copper sulphate is present in the pulp in at least the final agitation conditioning stage prior to subjecting the said pulp to flotation.

5. The process of claim 1, wherein at least one of the said acid agents is selected from the group consisting of sulfuric acid, sulfurous acid and sulfur dioxide.

6. The process of claim 1, wherein the said sufficient period of time in at least one agitation conditioning stage in the pH range of about 1.5 to 5.0 is in the time period of about 6 minutes to 30 minutes.

7. The process of claim 1, wherein the said sufficient period of time in the at least one conditioning stage in the pH range of about 1.5 to 5.0 is in the time period of about 9 minutes to 18 minutes.

8. The process of claim 1, wherein the said sufficient period of time in the pH range of about 5.0 to 11.5 is in the range of about 3.0 to 20 minutes.

9. The process of claim 1, wherein the said sufficient period of time in the pH range of about 5.0 to 11.5 is in the range of about 3 to 6 minutes.

10. The process of claim 1, wherein a dispersing agent is present in the pulp in at least the last agitation conditioning stage prior to subjecting the said agitation conditioned pulp to flotation.

11. A process for the recovery of froth flotation of mineral values selected from the group consisting of gold, silver sulphide minerals, bismuth sulphide minerals, and uranium oxides, associated with gold values from complex ores and metallurgical plant products containing at least one of the said minerals comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time and with sufficient energy input to the said pulp to bring about heavy activation of at least one of the said mineral values in at least one subsequent mechanical agitation conditioning stage wherein the said pulp is further agitation conditioned for a sufficient period of time and with sufficient energy input to the said pulp and at an optimum pH point in the pH range of about 5.0 to 11.5 in the presence of at least one collector selected from the group of sulfhydryl anionic sulphide mineral collectors to produce the said heavy activation of at least one of the said mineral values; and subsequently in the presence of a frother subjecting the said agitation conditioned pulp to flotation to produce a concentrate enriched in at least one of the said mineral values, and a tailings product impoverished in at least the same said mineral value.

12. The process of claim 11, wherein the said total sufficient energy input to the pulp as represented by the total power consumption of the said mechanical agitation conditioning is in the range of about 0.25 to 5.0 kilowatt hours per dry metric ton of solids fed to the total agitation conditioning circuit.

13. The process of claim 11, wherein the said total sufficient energy input to the pulp as represented by the total power consumption of the said mechanical agitation conditioning is in the range of about 0.5 to 2.5 kilowatt hours per dry metric ton of solids fed to the total agitation conditioning circuit.

14. A process for the recovery by froth flotation of mineral values selected from the group consisting of gold, silver sulphide minerals, bismuth sulphide minerals and uranium oxides associated with gold values, from complex ores and metallurgical plant products containing at least one of the said minerals comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of at least gold and at least one of the other said mineral values in at least one subsequent mechanical agitation conditioning stage wherein the pulp is further agitation conditioned for a sufficient period of time and with sufficient energy input to the pulp and wherein the pH of the said pulp has been raised to an optimum pH point within the pH range of about 5.0 to 11.5 with an alkaline agent selected from the group consisting of lime, calcium hyroxide, ammonium hydroxide, sodium carbonate and sodium hydroxide in the presence of at least one collector selected from the group of sulfhydryl anionic sulphide mineral collectors to produce the said heavy activation of at least one of the said mineral values; and subsequently in the presence of a frother subjecting the said agitation conditioned pulp to flotation to produce a concentrate enriched in at least one of the said mineral values and a tailings product impoverished in at least the same said mineral value.

15. A process for the recovery by froth flotation of gold and gold bearing sulphide minerals selected from the group consisting of, pyrite and arsenopyrites from complex ores and metallurgical plant products comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of the said gold and at least one of the said gold bearing sulphide minerals in at least one subsequent mechanical agitation conditioning stage wherein the said pulp is further agitation conditioned for a sufficient period of time and at an optimum pH point in the pH range of about 5.0 to 11.0 and in the presence of an alkaline agent when the said optimum pH point is in the pH range of about 6.0 to 11.5 and in the presence of at lease one collector selected from the group of sulfhydryl anionic sulphide mineral collectors to produce the said heavy activation of the said gold and at least one of the said gold bearing sulphide minerals; subsequently in the presence of a frother subjecting the said agitation conditioned pulp to flotation to produce a concentrate enriched in the said gold and at least one of the said gold bearing sulphide minerals, and a tailings product impoverished in the said gold and at least one said same gold bearing sulphide mineral.

16. The process of claim 15 wherein subsequent to the said at least one agitation conditioning stage in the pH range of about 1.5 to 5.0 there are at least two agitation conditioning stages in the pH range of about 5.0 to 11.0.

17. The process of claim 15 wherein preceeding the said at least one agitation conditioning stage in the pH range of about 1.5 to 5.0 there is at least one agitation conditioning stage in the pH range of about 6.0 to 10.5.

18. The process of claim 15 wherein copper sulphate is present in the said pulp in at least the final agitation conditioning stage prior to flotation.

19. The process of claim 15 wherein at least one of the said acid agents is selected from the group consisting of sulfuric acid, sulfurous acid and sulfur dioxide.

20. The process of claim 15 wherein the said sufficient period of time in the said at least one agitation conditioning stage in the pH range of about 1.5 to 5.0 is in the time period of about 6 minutes to 30 minutes.

21. The process of claim 15 wherein the said sufficient period of time in the said at least one agitation conditioning stage in the pH range of about 1.5 to 5.0 is in the time period of about 9 minutes to 18 minutes.

22. The process of claim 15 wherein the said sufficient period of time in the pH range of about 5.0 to 11.0 is in the range of about 3.0 to 20 minutes.

23. The process of claim 15 wherein the said sufficient period of time in the pH range of about 5.0 to 11.0 is in the range of about 3 to 6 minutes.

24. The process of claim 15 wherein a dispersing agent is present in the said pulp in at least the last agitation conditioning stage prior to subjecting the said agitation conditioned pulp to flotation.

25. A process for the recovery by froth flotation of gold, and gold bearing sulphide minerals selected from the group consisting of, pyrite, arsenopyrite, and gold bearing carbon based minerals from complex ores and metallurgical plant products comprising: subjecting a suitably prepared pulp of the material to mechanical agitation in at least one agitation conditioning stage wherein the pH of said pulp has been lowered with an acid agent to an optimum pH point within the pH range of about 1.5 to 5.0 and wherein the agitation conditioning is for a sufficient period of time and with sufficient energy input to the said pulp to bring about heavy activation of the gold and at least one of the said gold bearing minerals in at least one subsequent mechanical agitation conditioning stage wherein the said pulp is further agitation conditioned for a sufficient period of time with sufficient energy input to the said pulp at an optimum pH point in the range of about 5.0 to 11.0 and in the presence of an alkaline agent when the said optimum pH point is in the pH range of about 6.0 to 11.5 and in the presence of at least one collector selected from the group of sulfhydryl anionic sulphide mineral collectors to produce the said heavy activation of the said gold and at least one of the said gold bearing minerals; subsequently in the presence of a frother subjecting the said agitation conditioned pulp to flotation to produce a concentrate enriched in the said gold and at least one of the said gold bearing minerals, and a tailings impoverished in the said gold and at least one of said gold bearing minerals.

26. The process of claim 25 wherein the said total sufficient energy input to the pulp as represented by the total power consumption of the said mechanical agitation conditioning is in the range of about 0.25 to 5.0 kilowatt hours per dry metric ton of solids fed to the total agitation conditioning circuit.

27. The process of claim 25 wherein the said total sufficient energy input to the pulp as represented by the total power consumption of the said mechanical agitation conditioning is in the range of 0.5 to 2.5 kilowatt hours per dry metric ton of solids fed to the total agitation conditioning circuit.

28. The process of claim 25 wherein prior to the said at least one agitation conditioning stage in the pH range of about 1.5 to 5.0 a carbon based mineral flotation concentrate is removed from the said suitably prepared pulp of the material.

29. The process of claim 25 wherein subsequent to the said at least one agitation conditioning stage in the pH range of about 1.5 to 5.0 and prior to the said at least one agitation conditioning stage in the pH range of about 5.0 to 11.5 a carbon based mineral flotation concentrate is removed from the said pulp.

30. The process of claim 25 wherein subsequent to the said subjecting the said agitation conditioned pulp to flotation the remaining pulp is subjected to a further stage of flotation to produce a second concentrate enriched in gold values and a tailings impoverished in carbon based mineral and gold values.

31. A process for the recovery by froth flotation of gold and gold bearing sulphide minerals selected from the group consisting of pyrite and arsenopyrite from complex ores and metallurgical plant products comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of the said gold and at least one of the said gold bearing sulphide minerals in at least one subsequent mechanical agitation conditioning stage wherein the pulp is further agitation conditioned for a sufficient period of time and with sufficient energy input to the pulp and wherein the pH of the said pulp has been raised to an optimum pH point within the pH range of about 5.0 to 11.5 with an alkaline agent selected from the group consisting of lime, calcium hydroxide, ammonium hydroxide, sodium carbonate and sodium hydroxide in the presence of at least one collector selected from the group of sulfhydryl anionic collectors to produce the said heavy activation of the said gold at least one of the said gold bearing sulphide minerals; subsequently in the presence of a frother subjecting the said agitation conditioned pulp to flotation to produce a concentrate enriched in the said gold and at least one of the said gold bearing sulphide minerals and a tailings product impoverished in the said gold and at least one of said gold bearing sulphide minerals.

32. A process for the recovery by froth flotation of gold, uranium mineral values, carbon based mineral from ores and metallurgical plant products comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of the said gold and at least part of the said uranium mineral values in at least one subsequent mechanical agitation conditioning stage wherein the said pulp is further agitation conditioned for a sufficient period of time and at an optimum pH point in the pH range of about 5.0 to 11.5 and in the presence of an alkaline agent when the said optimum pH point is in the pH range of about 6.0 to 11.5 and in the presence of at least one collector selected from the group of sulfhydryl anionic collectors and at least one additional collector selected from the group consisting of oxyhydryl anionic collectors and cationic collectors to produce the said heavy activation of at least the gold and at least part of the said uranium mineral values and carbon based mineral; subsequently in the presence of a frother subjecting the said agitation conditioned pulp to flotation to produce a concentrate enriched in the said gold and at least part of the said uranium mineral values and carbon based minerals and a tailings product impoverished in the said gold and at least part of the said uranium mineral values and carbon based mineral.

33. The process of claim 32 wherein prior to the said at least one agitation conditioning stage in the pH range of about 1.5 to 5.0 a carbon based mineral flotation concentrate is removed from the said suitably prepared pulp of the material.

34. The process of claim 32 wherein subsequent to the said at least one agitation conditioning stage in the pH range of about 1.5 to 5.0 and prior to the said at least one agitation conditioning stage in the pH range of about 5.0 to 11.5 a carbon based mineral flotation concentrate is removed from the said pulp.

35. The process of claim 32 wherein subsequent to the said subjecting the said agitation conditioned pulp to flotation the remaining pulp is subjected to a further stage of flotation to produce a second concentrate enriched in carbon based mineral and gold values and a tailing impoverished in carbon based mineral and gold values.

36. A process for the recovery by froth flotation of sulphide minerals selected from the group of minerals consisting of silver sulphide minerals and bismuth sulphide minerals from complex ores and metallurgical plant products comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of at least one of the said sulphide minerals in at least one subsequent mechanical agitation conditioning stage wherein the pulp is further agitation conditioned for a sufficient period of time and with sufficient energy input to the pulp and wherein the pH of the said pulp has been raised to an optimum pH point within the pH range of about 5.0 to 11.5 with an alkali agent selected from the group consisting of lime, calcium hydroxide, ammonium hydroxide, sodium carbonate, potassium carbonate and sodium hydroxide in the presence of at least one collector selected from the group of sulfhydryl anionic collectors to produce the said heavy activation of the said minerals; subsequently in the presence of a frother subjecting the said agitation conditioned pulp to flotation to produce a concentrate enriched in the said minerals and a tailings product impoverished in the said minerals.

37. The process of claim 36 wherein copper sulphate is present in the pulp in at least the said agitation conditioning within the pH range of about 5.0 to 11.5.

38. A process for the recovery by froth flotation of minerals selected from the group of minerals consisting of gold and gold bearing (arsenopyrites, pyrites and chalcopyrites) from complex ores and metallurgical plant products comprising: subjecting a suitably prepared pulp of the material to mechanical agitation in at least one agitation conditioning stage wherein the pH of the said pulp has been lowered with an acid agent to an optimum pH point within the pH range of about 1.5 to 5.0 and wherein the agitation conditioning is for a sufficient period of time to bring about heavy activation of the said minerals in at least one subsequent mechanical agitation conditioning stage wherein the pH of the said agitation conditioned pulp is raised to within the pH range of 5.0 to 11.5 and in the presence of an alkaline agent when the said optimum pH point is in the pH range of about 6.0 to 11.5 and is further agitation conditioned for a sufficient period of time and with sufficient energy to the pulp and in the presence of at least one collector selected from the group of sulfhydryl anionic sulphide mineral collectors to produce the said heavy activation of the said minerals; subsequently in the presence of a frother subjecting the said at least two stage agitation conditioned pulp to flotation to produce a concentrate enriched in one or more of the said minerals and a tailings product impoverished in one or more of the said same minerals.

39. The process of claim 38 wherein the said raising of the pulp pH to within the pH range of 5.0 to 11.5 is achieved by agitation conditioning the said pulp in the pH range of about 1.5 to 5.0 for a sufficient period of time to bring about the said raising of the pulp pH to within the said pH range of 5.0 to 11.5.

40. The process of claim 38 wherein the said raising of the pulp pH to within the pH range of 5.0 to 11.5 is achieved by the addition to the said pulp of an alkali agent selected from the group of agents consisting of lime, calcium hydroxide, ammonium hydroxide, sodium hydroxide, sodium carbonate and potassium carbonate.

41. The process of claim 39 wherein the said raising of the pulp pH is achieved by the combination of agitation conditioning the said pulp in the pH range of 1.5 to 5.0 for a sufficient period of time and with the addition of an alkaline agent to bring about the said raising of the pulp pH to within the said pH range of 5.0 to 11.5.

* * * * *

UNITED STATES PATENT OFFICE

CERTIFICATE OF CORRECTION

Patent No. 3,964,997 Dated June 22, 1976

Inventor(s) David Weston

It is certified that error appears in the above-identified patent and that said Letters Patent are hereby corrected as shown below:

Column 1, line 24, delete "pyrite may carry substantial gold bearing sulphide, or" and insert in lieu thereof --pyrite may carry substantial gold values, herein referred to as a gold bearing mineral or gold bearing sulphide, or--.

Column 1, line 41, delete "wich" and insert --which--.

Column 1, line 54, delete "ing" and insert --ings--.

Column 3, line 67, delete "rotated" and insert --roasted--.

Column 7, line 23, delete "90".

Column 7, line 53, delete "state" and insert --stage--.

Column 7, line 47, delete "conditioned".

Column 8, line 19, delete "storage" and insert --stage--.

Column 10, line 10, delete "3 ccs" and insert --8 ccs--.

Column 11, line 68, delete "through" and insert --thorough--

Column 13, line 19, delete "of" and insert --by--.

Column 16, line 32, delete "gold at least" and insert --gold and at least--.

Signed and Sealed this

First Day of February 1977

[SEAL]

*Attest:*

RUTH C. MASON
*Attesting Officer*

C. MARSHALL DANN
*Commissioner of Patents and Trademarks*